US005667925A

United States Patent [19]

Tsuruoka et al.

[11] Patent Number: 5,667,925

[45] Date of Patent: Sep. 16, 1997

[54] ELECTROPHOTOGRAPHIC PHOTOSENSITIVE PRODUCT

[75] Inventors: Eriko Tsuruoka; Akira Hirano, both of Tokyo, Japan

[73] Assignee: NEC Corporation, Tokyo, Japan

[21] Appl. No.: 645,354

[22] Filed: May 13, 1996

[30] Foreign Application Priority Data

May 12, 1995 [JP] Japan ..... 7-114192

[51] Int. Cl.[6] ..... G03G 5/047; G03G 5/09

[52] U.S. Cl. ..... 430/59; 430/73; 430/83

[58] Field of Search ..... 430/59, 73, 83

[56] References Cited

U.S. PATENT DOCUMENTS

| | | | |
|---|---|---|---|
| 3,820,989 | 6/1974 | Rule et al. | 430/73 |
| 4,619,880 | 10/1986 | Horie et al. | 430/59 |
| 5,389,481 | 2/1995 | Saita et al. | 430/59 |

FOREIGN PATENT DOCUMENTS

| | | | |
|---|---|---|---|
| 5865440 | 4/1983 | Japan . | |
| 1-186961 | 7/1989 | Japan | 430/73 |
| 1-195455 | 8/1989 | Japan | 430/73 |

OTHER PUBLICATIONS

"Guiding Concept for Developing Better Charge Transporting Organic Materials", R. Takahashi et al., Journal of the Electrophotographic Society, vol. 25, No. 3, pp. 16–22 (1986).

*Primary Examiner*—Roland Martin

*Attorney, Agent, or Firm*—Sughrue, Mion, Zinn, Macpeak & Seas

[57] ABSTRACT

An electrophotographic photosensitive product comprises on a photoconductive substrate a photosensitive layer containing as a main component thereof a compound:

$$Ar^5-\underset{R^2}{C}=\underset{R^1}{C}-Ar1-\underset{Ar^2}{N}-X-\underset{Ar^3}{N}-Ar4-\underset{R^3}{C}=\underset{R^4}{C}-Ar^6$$

wherein X is one of $-Ar^7-CH=CH-Ar^8-$ and a naphthylene group represented by the following formula:

and wherein each of $Ar^1$, $Ar^4$, $Ar^7$, and $Ar^8$ represents an arylene group, each of $Ar^2$, $Ar^3$, $Ar^5$, and $Ar^6$ represents an aryl group, and each of $R^1$–$R^6$ represents one of H, a lower alkyl group and an aryl group.

10 Claims, 2 Drawing Sheets

ELECTROPHOTOGRAPHIC PHOTOSENSITIVE PRODUCT

BACKGROUND OF THE INVENTION (a) Field of the Invention

The present invention relates to an electrophotographic photosensitive product suitable for use in copying machines, printers, facsimile equipment, electronic photolithography, solar cells, photoelectric converting elements such as electroluminescent elements, light converting elements, and optical discs. Particularly, the present invention relates to an electrophotographic photosensitive product having a photosensitive layer formed of a charge generating substance and a charge transporting substance.

(b) Description of the Related Art

Conventionally, inorganic substances such as selenium (Se), cadmium sulfide (CdS), zinc oxide (ZnO), and amorphous silicon (a-Si) are used as photoconductive materials of photosensitive products used in electrophotographic systems. Photosensitive products including the above inorganic photoconductive materials have many advantages, but also have various disadvantages such as a property of being harmful, problematic disposal, and a relatively high cost. In recent years, therefore, many organic photosensitive products free of these disadvantages have been proposed and practically used.

These organic photosensitive products are classified into functionally layered photosensitive products and single-layer photosensitive products in accordance with their structures. A functionally layered photosensitive product has a multi-layer structure in which a material for generating charged carriers (hereinafter referred to as a charge generating material) is layered separately from a material for transporting charged carriers generated in the charge generating material (hereinafter referred to as a charge transporting material). In a single-layer photosensitive product, generation of charged carriers and transport of the generated charged carriers are both performed within a single layer. The functionally layered photosensitive product is preferable because it provides wider selection of materials and can provide a higher sensitivity. Charge transporting media are classified into two types. One type uses polymeric photoconductive compounds such as polyvinylcarbazole while the other type uses low-molecular photoconductive compounds dissolved in a binder.

Since a polymeric photoconductive compound described above does not by itself have a sufficient film-forming property or bonding property, a plasticizer, a binder polymer, and other materials are added thereto for improving the properties. This addition may reduce sensitivity of a photosensitive product, thus hindering practical use of the photosensitive product.

By contrast, a photosensitive product using an appropriately selected low-molecular weight photoconductive compound provides excellent mechanical characteristics, while fails to provide a sufficiently acceptable sensitivity or stability against repeated processing. For example, a diaryl alkane derivative disclosed in U.S. Pat. No. 3,820,989 has substantially no particular problem regarding the compatibility with a binder polymer, while shows poor stability against light. Hence, when the derivative is used in a photosensitive layer of a product for electrophotographic use, the sensitivity of the photosensitive product gradually decreases as the material is repeatedly charged and exposed.

When either a stilbene compound described in Patent Publication No. JP-A-1983-65440 or N,N'-tetra (3-methylphenyl)-4,4'-diaminostilbene described in Journal of the Electrophotographic Society, vol. 25, No. 3, pp. 16-(1986), is used as a photosensitive product, sufficient sensitivity and repeatability are not provided due to an insufficient transporting capability.

SUMMARY OF THE INVENTION

In view of the foregoing, it is an object of the present invention to provide an electrophotographic photosensitive product having a higher sensitivity and excellent repeatability.

To achieve the above object, we carried out earnest studies and found that a photosensitive product containing a compound represented by formula (1) below provides a higher sensitivity and reliable repeatability of characteristics.

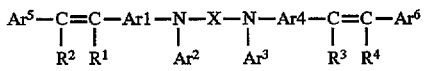

$$Ar^5-\underset{R^2}{C}=\underset{R^1}{C}-Ar1-\underset{Ar^2}{N}-X-\underset{Ar^3}{N}-Ar4-\underset{R^3}{C}=\underset{R^4}{C}-Ar^6 \quad (1)$$

wherein X is $-Ar^7-CH=CH-Ar^8-$ or a naphthylene group represented by the following formula:

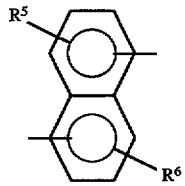

In formula (1), each of $Ar^1$, $Ar^4$, $Ar^7$, and $Ar^8$ represents a substituted or unsubstituted arylene group, each of $Ar^2$, $Ar^3$, $Ar^5$, and $Ar^6$ represents a substituted or unsubstituted aryl group, and each of $R^1$–$R^6$ represents H, a C1–C6 lower alkyl group which may have a substituent, or a substituted or unsubstituted aryl group.

The compound represented by formula (1), which is referred to as triphenylamine derivatives herein, exhibit relatively high mobilities, and photosensitive products containing the derivatives as a main component thereof according to the present invention have an excellent photosensitivity.

The above and other objects, features and advantages of the present invention will be more apparent from the following description.

DESCRIPTION OF THE PREFERRED EMBODIMENTS

Figure 1:
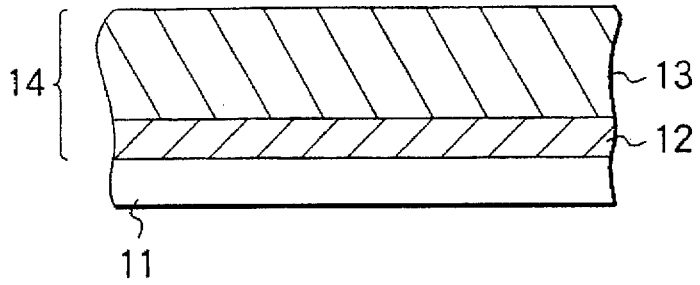
FIG. 1 is a cross-sectional view of a known structure of an electrophotographic photosensitive product implementing a first embodiment of the present invention.
Figure 2:
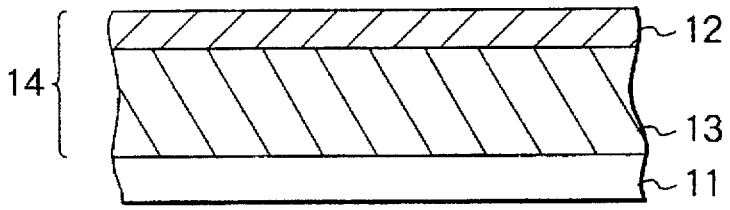
FIG. 2 is a cross-sectional view of a known structure of an electrophotographic photosensitive product implementing a second embodiment of the present invention.

First, the compounds represented by formula (1) will be described in detail.

Examples of the aryl group include phenyl, naphthyl, and biphenyl. Examples of the arylene group include phenylene, naphthylene, and biphenylene.

Examples of the alkyl group include methyl, ethyl, propyl, isopropyl, butyl, pentyl, and hexyl. Each of these aryl, arylene, and alkyl groups may have a substituent. Examples of the substituent include: alkyl groups such as methyl, ethyl, propyl, isopropyl, n-butyl, t-butyl, pentyl, and hexyl; alkoxy groups such as methoxy, ethoxy, propoxy, and butoxy; amino groups such as amino, dimethylamino, diethylamino, and diphenylamino; and halogens such as fluorine, chlorine, bromine, and iodine.

Preferred compounds according to the present invention expressed by formula (1) are shown in Tables 1 to 3 wherein X is a naphthylene group, and also shown in Tables 4 and 5 wherein X is —$Ar^7$—CH=CH—$Ar^8$—. However, these embodiments should not be construed as limiting the invention.

A compound corresponding to that represented by formula

TABLE 1

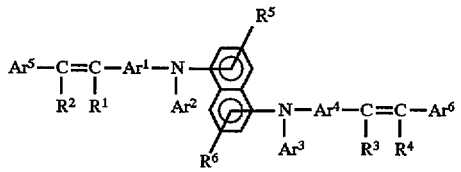

| No. | $Ar^1$ | $Ar^2$ | $Ar^3$ | $Ar^4$ | $Ar^5$ $Ar^6$ | $R^1$ $R^3$ | $R^2$ $R^4$ | $R^5$ | $R^6$ | amino |
|---|---|---|---|---|---|---|---|---|---|---|
| 1 | | | | | $CH_3$ | H | $CH_3$ | 4-$CH_3$ | 8-$CH_3$ | 1.5 |
| 2 | | | | | | H | | 4-$CH_3$ | 8-$CH_3$ | 1.5 |
| 3 | | | | | $CH_3$, $CH_3$ | H | H | 4-$CH_3$ | 8-$CH_3$ | 1.5 |
| 4 | | | | | $OCH_3$ | H | H | 4-$CH_3$ | 8-$CH_3$ | 1.5 |
| 5 | | | | | $NEt_2$ | H | H | 4-$CH_3$ | 8-$CH_3$ | 1.5 |
| 6 | | | | | $CH_3$ | H | $CH_3$ | 4-$CH_3$ | 8-$CH_3$ | 1.5 |
| 7 | | $CH_3$ | $CH_3$ | | $CH_3$ | H | $CH_3$ | 4-$CH_3$ | 8-$CH_3$ | 1.5 |
| 8 | | $CH_3$ | $CH_3$ | | Cl | H | H | 4-$CH_3$ | 8-$CH_3$ | 1.5 |
| 9 | | $CH_3$ | $CH_3$ | | $CH_3$ | H | H | 4-$CH_3$ | 8-$CH_3$ | 1.5 |
| 10 | | $CH_3$ | $CH_3$ | | $OCH_3$ | H | H | 4-$CH_3$ | 8-$CH_3$ | 1.5 |
| 11 | | $OCH_3$ | $OCH_3$ | | $CH_3$ | H | $CH_3$ | 4-$CH_3$ | 8-$CH_3$ | 1.5 |
| 12 | | $OCH_3$ | $OCH_3$ | | $CH_3$ | H | H | 4-$CH_3$ | 8-$CH_3$ | 1.5 |
| 13 | | $OCH_3$ | $OCH_3$ | | $NEt_2$ | H | H | 4-$CH_3$ | 8-$CH_3$ | 1.5 |

TABLE 2
| No. | $Ar^1$ | $Ar^2$ | $Ar^3$ | $Ar^4$ |
|---|---|---|---|---|
| 14 | 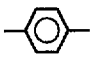 | 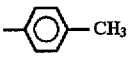 | 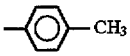 | 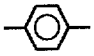 |
| 15 | 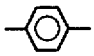 | 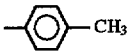 | 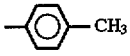 | 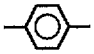 |
| 16 | 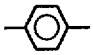 | 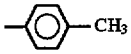 | 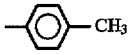 | 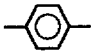 |
| 17 | 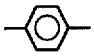 | 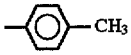 | 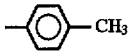 | 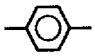 |
| 18 | 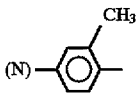 | 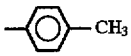 | 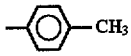 | 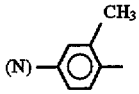 |
| 19 | 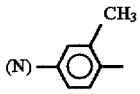 | 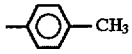 | 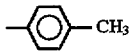 | 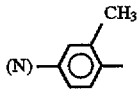 |
| 20 | 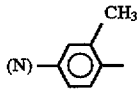 | 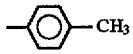 | 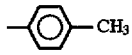 | 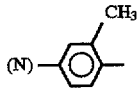 |
| 21 | 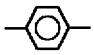 | 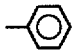 | 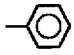 | 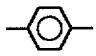 |
| 22 | 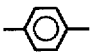 | 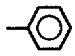 | 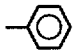 | 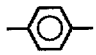 |
| 23 | 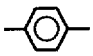 | 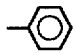 | 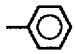 | 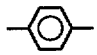 |
| 24 | 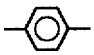 | 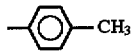 | 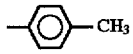 | 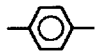 |
| 25 | 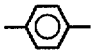 | 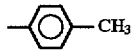 | 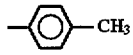 | 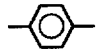 |
| 26 | 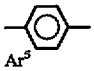 | 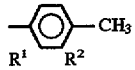 | 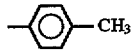 | 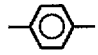 |
| No. | $Ar^5$ $Ar^6$ | $R^1$ $R^3$ | $R^2$ $R^4$ | $R^5$ | $R^6$ | amino |
|---|---|---|---|---|---|---|
| 14 | 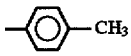 | H | 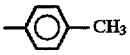 | 3-$CH_3$ | 7-$CH_3$ | 1.5 |
| 15 | 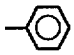 | H | 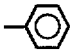 | 3-$CH_3$ | 7-$CH_3$ | 1.5 |
| 16 | 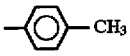 | H | H | 3-$CH_3$ | 7-$CH_3$ | 1.5 |
| 17 | 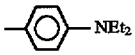 | H | H | 3-$CH_3$ | 7-$CH_3$ | 1.5 |
| 18 | 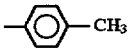 | H | 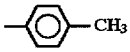 | 4-$CH_3$ | 8-$CH_3$ | 1.5 |
| 19 | 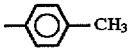 | H | H | 4-$CH_3$ | 8-$CH_3$ | 1.5 |
| 20 | 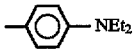 | H | H | 4-$CH_3$ | 8-$CH_3$ | 1.5 |
| 21 | 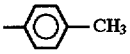 | H | 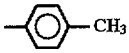 | 4-$CH_3$ | 8-$CH_3$ | 2.6 |

TABLE 2-continued
| | | | | | | |
|---|---|---|---|---|---|---|
| 22 | 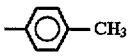 | H | H | 4-$CH_3$ | 8-$CH_3$ | 2.6 |
| 23 | 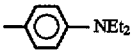 | H | H | 4-$CH_3$ | 8-$CH_3$ | 2.6 |
| 24 | 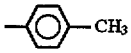 | H | 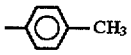 | H | H | 2.6 |
| 25 | 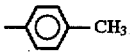 | H | H | H | H | 2.6 |
| 26 | 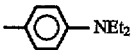 | H | H | H | H | 2.6 |
TABLE 3
| No. | $Ar^1$ | $Ar^2$ | $Ar^3$ | $Ar^4$ |
|---|---|---|---|---|
| 27 | 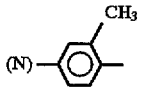 | 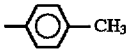 | 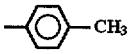 | 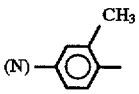 |
| 28 | 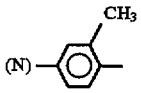 | 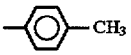 | 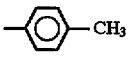 | 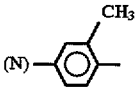 |
| 29 | 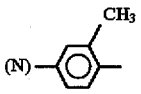 | 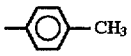 | 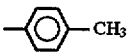 | 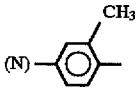 |
| 30 | 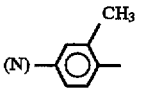 | 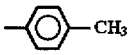 | 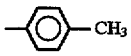 | 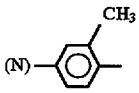 |
| 31 | 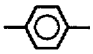 | 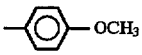 | 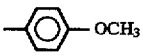 | 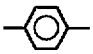 |
| 32 | 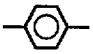 | 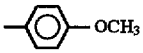 | 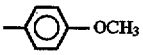 | 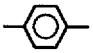 |
| 33 | 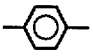 | 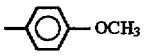 | 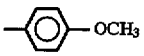 | 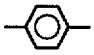 |
| 34 | 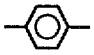 | 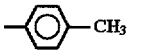 | 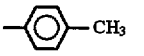 | 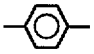 |
| 35 | 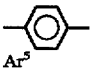 | 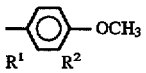 | 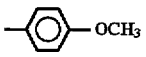 | 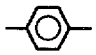 |
| No. | $Ar^5$ $Ar^6$ | $R^1$ $R^3$ | $R^2$ $R^4$ | $R^5$ | $R^6$ | amino |
|---|---|---|---|---|---|---|
| 27 | 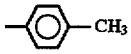 | H | $CH_3$ | 4-$CH_3$ | 8-$CH_3$ | 2.6 |
| 28 | 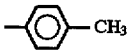 | H | 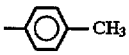 | 4-$CH_3$ | 8-$CH_3$ | 2.6 |
| 29 | 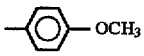 | H | H | 4-$CH_3$ | 8-$CH_3$ | 2.6 |
| 30 | 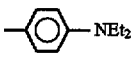 | H | H | 4-$CH_3$ | 8-$CH_3$ | 2.6 |

TABLE 3-continued
| | | | | | | |
|---|---|---|---|---|---|---|
| 31 | 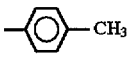 | H | 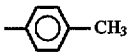 | H | H | 2.6 |
| 32 | 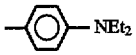 | H | H | H | H | 2.6 |
| 33 | 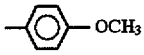 | H | H | 4-$CH_3$ | 8-$CH_3$ | 2.6 |
| 34 | 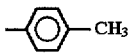 | H | $CH_3$ | 4-$CH_3$ | 8-$CH_3$ | 1.5 |
| 35 | 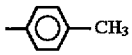 | H | $CH_3$ | H | H | 1.5 |
TABLE 4
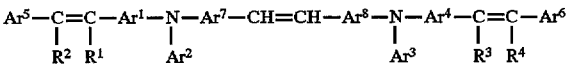
| No. | $Ar^1$ | $Ar^2$ | $Ar^3$ | $Ar^4$ | $Ar^5$, $Ar^6$ | $Ar^7$ | $Ar^8$ | $R^1$, $R^3$ | $R^2$, $R^4$ |
|---|---|---|---|---|---|---|---|---|---|
| 1 | 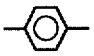 | 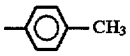 | 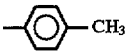 | 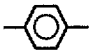 | 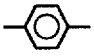 | 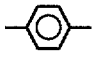 | 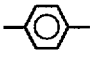 | H | H |
| 2 | 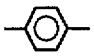 | 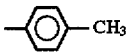 | 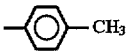 | 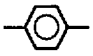 | 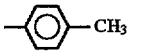 | 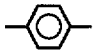 | 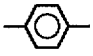 | H | H |
| 3 | 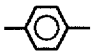 | 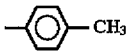 | 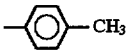 | 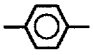 | 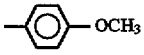 | 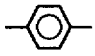 | 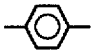 | H | H |
| 4 | 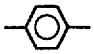 | 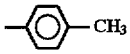 | 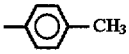 | 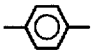 | 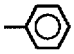 | 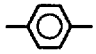 | 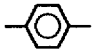 | H | 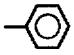 |
| 5 | 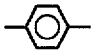 | 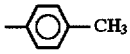 | 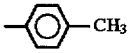 | 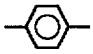 |  |  |  | H |  |
| 6 |  |  |  |  |  |  |  | H | H |
| 7 |  |  |  |  |  |  |  | H | H |
| 8 |  |  |  |  |  |  |  | H |  |
| 9 |  |  |  |  |  |  |  | H |  |
| 10 |  |  |  |  |  |  |  | $CH_3$ |  |
| 11 |  |  |  |  |  |  |  | H | H |
| 12 |  |  |  |  |  |  |  | H | H |
| 13 |  |  |  |  |  |  |  | H |  |

TABLE 4-continued
$Ar^5-C(R^2)=C(R^1)-Ar^1-N(Ar^2)-Ar^7-CH=CH-Ar^8-N(Ar^3)-Ar^4-C(R^3)=C(R^4)-Ar^6$
| No. | $Ar^1$ | $Ar^2$ | $Ar^3$ | $Ar^4$ | $Ar^5$, $Ar^6$ | $Ar^7$ | $Ar^8$ | $R^1$, $R^3$ | $R^2$, $R^4$ |
|---|---|---|---|---|---|---|---|---|---|
| 14 | 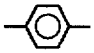 | 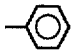 | 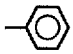 | 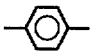 | 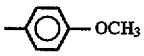 | 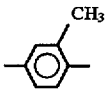 | 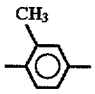 | H | H |
| 15 | 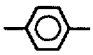 | 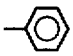 | 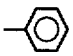 | 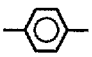 | 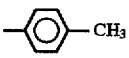 | 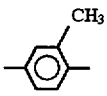 | 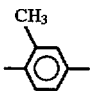 | H | 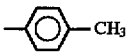 |
TABLE 5
| No. | $Ar^1$ | $Ar^2$ | $Ar^3$ | $Ar^4$ |
|---|---|---|---|---|
| 16 | 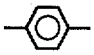 | 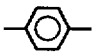 | 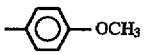 | 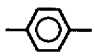 |
| 17 | 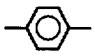 | 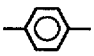 | 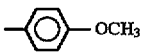 | 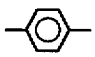 |
| 18 | 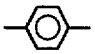 | 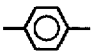 | 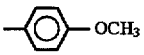 | 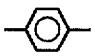 |
| 19 | 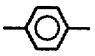 | 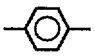 | 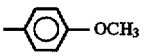 | 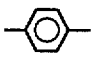 |
| 20 | 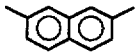 | 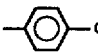 | 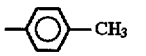 | 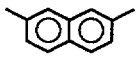 |
| 21 | 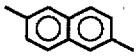 | 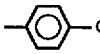 | 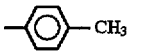 | 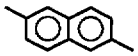 |
| 22 | 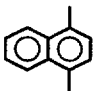 | 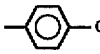 | 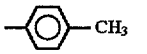 | 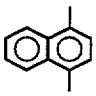 |
| 23 | 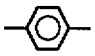 | 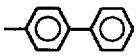 | 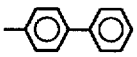 | 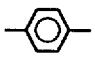 |
| 24 | 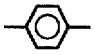 | 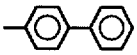 | 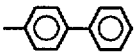 | 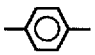 |
| 25 | 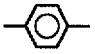 | 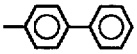 | 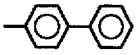 | 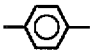 |
| 26 | 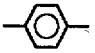 | 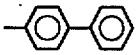 | 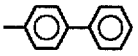 | 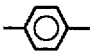 |
| 27 | 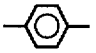 | 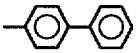 | 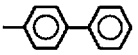 | 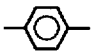 |
| 28 | 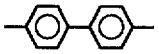 | 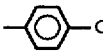 | 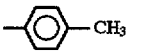 | 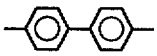 |
| 29 | 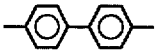 | 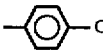 | 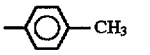 | 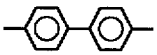 |
| 30 | 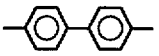 | 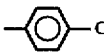 | 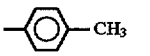 | 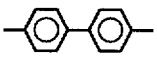 |
| No. | $Ar^5$, $Ar^6$ | $Ar^7$ | $Ar^8$ | $R^1$, $R^3$ | $R^2$, $R^4$ |
|---|---|---|---|---|---|
| 16 | 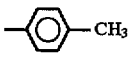 | 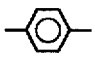 | 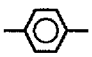 | H | H |

TABLE 5-continued

| | | | | | |
|---|---|---|---|---|---|
| 17 | 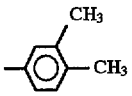 | 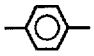 | 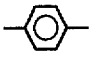 | H | H |
| 18 | 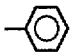 | 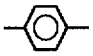 | 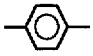 | H | 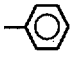 |
| 19 | 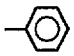 | 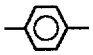 | 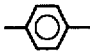 | $CH_3$ | 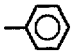 |
| 20 | 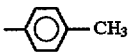 | 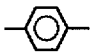 | 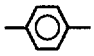 | H | H |
| 21 | 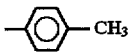 | 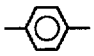 | 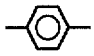 | H | H |
| 22 | 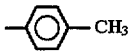 | 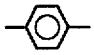 | 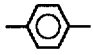 | H | H |
| 23 | 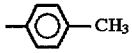 | 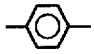 | 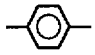 | H | H |
| 24 | 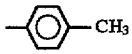 | 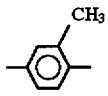 | 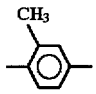 | H | H |
| 25 | 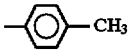 | 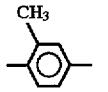 | 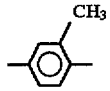 | H | H |
| 26 | 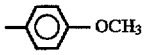 | 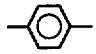 | 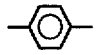 | H | H |
| 27 | 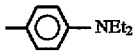 | 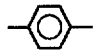 | 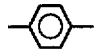 | H | H |
| 28 | 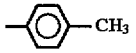 | 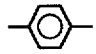 | 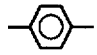 | H | H |
| 29 | 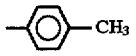 | 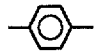 | 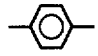 | H | 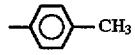 |
| 30 | 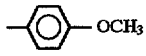 | 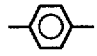 | 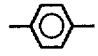 | H | H |

(1) can be synthesized using a known method. For example, an aryl amine compound represented by formula (2) as specified below is used as a starting material and is allowed to react with a formulating agent such as N,N-dimethylformamide in the presence of phosphorus oxychloride, thereby obtaining an aldehyde compound represented by formula (3) as specified below. When the thus obtained compound and a phosphonate derivative represented by formula (4) as specified below undergo condensation in a solvent such as N,N-dimethylformamide in the presence of sodium alkoxide or the like, the compound represented by formula (1) is obtained.

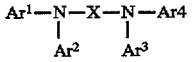

$$Ar^1-\underset{\underset{Ar^2}{|}}{N}-X-\underset{\underset{Ar^3}{|}}{N}-Ar4 \quad (2)$$

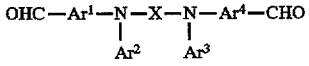

$$OHC-Ar^1-\underset{\underset{Ar^2}{|}}{N}-X-\underset{\underset{Ar^3}{|}}{N}-Ar^4-CHO \quad (3)$$

-continued

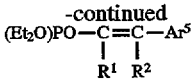

$$(Et_2O)PO-\underset{\underset{R^1}{|}}{C}=\underset{\underset{R^2}{|}}{C}-Ar^5 \quad (4)$$

Various components used in the present invention will now be described with reference to the accompanying drawings.

Referring to FIGS. 1 to 6, there are shown various known structures for an electrophotographic photosensitive product. An electrophotographic photosensitive product of the present invention may have any of these structures. In the electrophotographic photosensitive products shown in FIGS. 1 and 2, a photosensitive laminate 14 is composed of a charge generating layer 12 and a charge transporting layer 13 both layered on an electrically conductive base 11. The charge generating layer 12 contains a charge generating substance as a main component. The charge transporting layer 13 contains a charge transporting substance as a main component.

Figure 3:
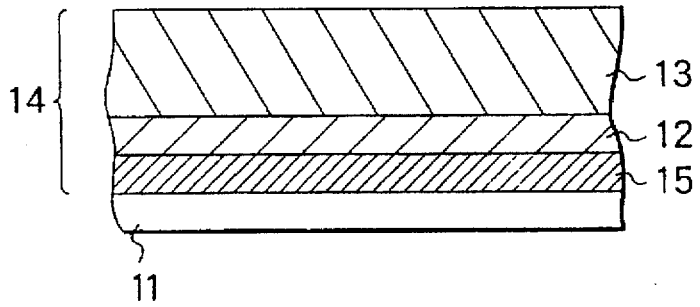
FIG. 3 is a cross-sectional view of a known structure of an electrophotographic photosensitive product implementing to a third embodiment of the present invention.
Figure 4:
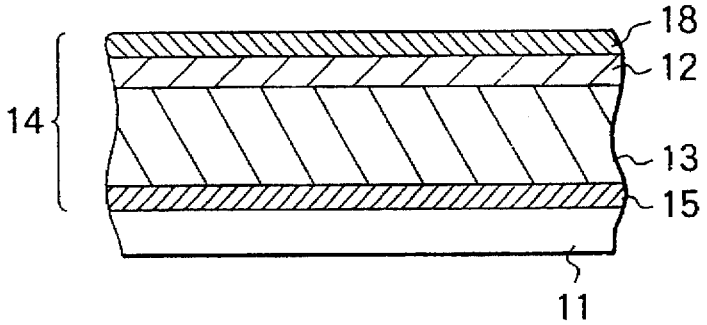
FIG. 4 is a cross-sectional view of a known structure of an electrophotographic photosensitive product implementing a fourth embodiment of the present invention.
Figure 5:
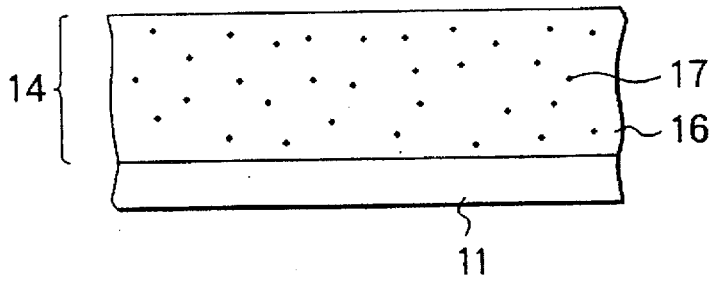
FIG. 5 is a cross-sectional view of a known structure of an electrophotographic photosensitive product implementing a fifth embodiment of the present invention.
Figure 6:
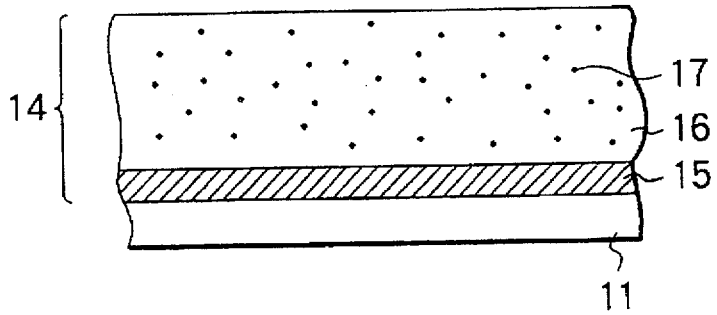
FIG. 6 is a cross-sectional view of a known structure of an electrophotographic photosensitive product implementing a sixth embodiment of the present invention.

As shown in FIGS. 3 and 4, an undercoat layer 15 may be provided on the electrically conductive base 11 so as to adjust the generation of charges. Also, a protective layer 18 may be provided as a top layer of the photosensitive laminate 14. When the photosensitive laminate 14 has a two-layer structure as described above, it provides a photosensitive product having most excellent electrophotographic characteristics. As shown in FIGS. 5 and 6, the photosensitive laminate 14 wherein a charge generating substance 17 is dispersed within a layer 16 containing a charge transporting substance as a main component thereof, may be disposed on the electrically conductive base 11 in direct contact therewith or with the undercoat layer 15 interposed therebetween.

In the present invention, a photosensitive laminate contains one or more kinds of compounds represented by formula (1). These compounds are soluble in tetrahydrofuran,chloroform, dichloromethane, dichloroethane, toluene, or a like solvent. Therefore, the compounds represented by formula (1) are dissolved and dispersed in such a solvent together with a binder, and the resulting mixture is applied to a base material or another layer to form a film having a higher mechanical strength. These compounds, therefore, are useful as charge transporting materials for electrophotographic photosensitive products.

In order to form a charge transporting layer, a charge transporting material and a binder material are mixed, the resulting mixture is dissolved in a solvent, and then the thus obtained solution is applied to a base material, another layer or the like. Various different solvents may be used for dissolving the materials depending on the kinds of the materials (resins or the like) to be dissolved. They are preferably selected from those which do not affect a charge generating layer and an undercoat layer, which are described below. Examples of the solvent include, although not limited to: aromatic hydrocarbons such as benzene, toluene, xylene, ligroin, monochlorobenzene, and dichlorobenzene; ketones such as acetone, methyl ethyl ketone, and cyclohexanone; alcohols such as methanol, ethanol, and isopropanol; esters such as ethyl acetate and methyl cellosolve; aliphatic hydrocarbon halides such as carbon tetrachloride, chloroform, dichloromethane, dichloroethane, and trichloroethylene; ethers such as tetrahydrofuran and dioxane; amides such as N,N-dimethylformamide and N,N-dimethylacetoamide; and sulfoxides such as dimethylsulfoxide.

A binder resin may be selected from among popular insulating resins and also from among organic photoconductive polymers such as polyvinylcarbazole resins, polyvinyl anthracene resins, and polyvinyl pyrene resins. Examples of an insulating resin include polyvinyl butyral resins, polyallylate resins, polycarbonate resins, polyester resins, polyester carbonate resins, phenoxy resins, polyvinyl acetate resins, acrylic resins, polyacrylamide resins, polyamide resins, polyvinyl pyridine resins, cellulose resins, urethane resins, epoxy resins, silicone resins, polystyrene resins, polyether resins, polythioether resins, polyketone resins, polyvinyl chloride resins, vinyl chloride-vinyl acetate copolymers, polyvinyl acetal resins, polyacrylonitrile resins, phenol resins, melamine resins, caseins, polyvinyl alcohol resins, polyvinyl pyrrolidone resins, and polysilanes. The binder resin is not limited to these resins. The resin is contained in the charge transporting layer in an amount of 99 to 0% by weight, preferably 70 to 30% by weight. One or more than one of these resins may be combined for use in the charge transporting layer.

The charge transporting layer of the electrophotographic photosensitive product preferably has a thickness of 5 to 50 μm, more preferably 10 to 30 μm. The charge transporting layer may contain, as needed, various generally used additives such as UV absorbers, oxidation inhibitors, electron attracting materials, and plasticizers.

The charge transporting layer is formed using an ordinary coating apparatus such as spin coaters, applicators, spray coaters, bar coaters, dip coaters, doctor blades, roller coaters, curtain coaters, bead coaters, and slide hoppers. The formed charge transporting layer is dried, preferably with heat at a temperature ranging from 40° to 300° C., more preferably from 60° to 200° C., for 2 minutes to 10 hours, more preferably for 10 minutes to 6 hours, in stationary or moving air.

Known photoconductive materials may be used singly or in combination therebetween as a charge generating material to be combined with a charge transporting material. Examples of a known photoconductive material include: inorganic materials such as CdS, Se, ZnO, and a-Si; and organic materials such as phthalocyanines having Si, Ge, Co, Cu, Al, In, Ti, Pb, V or a like metal, metal-free phthalocyanines, azo pigments, bis-azo pigments, tris-azo pigments, polycyclic quinone pigments, perinon pigments, cyanin dyes, and squalilium dyes.

The solvent used for dissolving a charge generating material depends on the kinds of the materials (resins) to be dissolved, and preferably does not affect an undercoat layer, which will be described later. Examples of the solvent include: aromatic hydrocarbons such as benzene, toluene, xylene, ligroin, monochlorobenzene, and dichlorobenzene; ketones such as acetone, methyl ethyl ketone, methyl isobutyl ketone, and cyclohexanone; alcohols such as methanol, ethanol, and isopropanol; esters such as ethyl acetate and methyl cellosolve; aliphatic hydrocarbon halogenides such as carbon tetrachloride, chloroform, dichloromethane, dichloroethane, and trichloroethylene; ethers such as tetrahydrofuran and dioxane; amides such as N,N-dimethylformamide and N,N-dimethylacetoamide; and sulfoxides such as dimethylsulfoxide.

In order to maintain a charge holding property and a stable performance, the charge generating layer of the electrophotographic photosensitive product preferably has a thickness of 0.01 to 2 μm, more preferably 0.1 to 1 μm. The charge generating layer may contain, as needed, a plasticizer, an electron acceptor, an electron donor, etc. in combination with a binder. The charge generating layer can be formed by a method similar to that for the charge transporting layer.

Substantially any ordinary resin can be used as a binder resin to be contained in the undercoat layer. Examples of the binder resin include polyamide resins soluble in alcohol such as nylon 6, nylon 66, nylon 11, nylon 610, copolymerized nylon, alkoxy methylated nylon; and cellulose resins such as casein, polyvinyl alcohol resins, ethylene-acrylic acid copolymers, vinyl chloride-vinyl acetate-maleic acid copolymers, epoxy resins, gelatins, polyurethane resins, polyvinyl butyral resins, nitrocellulose, and carboxymethyl cellulose. The resins described above can be used singly or in combination as a binder resin. An electron acceptor or electron donor may be added, as needed, to a binder resin. The undercoat layer may be formed in a manner similar to that for the charge transporting layer and the charge generated layer described above. The undercoat layer has a thickness of 0.01 to 20 μm, preferably 0.2 to 10 μm. The undercoat layer may be omitted as needed.

The present invention will next be described in detail by way of examples, which should not be construed as limiting the invention.

Embodiment 1

A charge generating layer (0.1 μm thick) containing 1 part of an n-type titanyl phthalocyanine and 2 parts of polyvinyl butyral (BX-1, Sekisui Chemical Co., Ltd.) was formed on an Alumite substrate. Then, a dichloroethane solution containing 7 parts of compound No.3 in Table 1 and 10 parts of polycarbonate (UPILON Z-200, Mitsubishi Gas Chemical Company, Inc.) was applied to the charge generating layer, followed by drying at 90° C. for 60 minutes to form a charge transporting layer having a thickness of 25 μm. The thus formed layer provided excellent workability in coating operation and a sufficient film strength.

Electrophotographic characteristics of the thus manufactured product was analyzed as described below by an electrostatic recording test apparatus manufactured by Kawaguchi Denki Co., Ltd. The product was electrostatically charged by corona discharge at −4.2 kV, followed by attenuation in the dark for 3 seconds. Then, the product was irradiated for 5 seconds with light having an intensity of 1 $\mu J/cm^2$ which had passed through a 780 nm interference filter, so as to measure a period of time required until the surface potential of the product was halved (half exposure time). The thus measured half exposure time was 0.25 sec.

Embodiments 2 to 22

A photosensitive product according to each of Embodiments 2 to 22 was manufactured in a manner similar to that described in Embodiment 1 except that one of the compound listed in Tables 1 to 5 other than compound No.3 in FIG. 1 was used in each product. The results of the analysis for the products are shown in Table 6.

TABLE 6

| Embodiment | Compound | Sensitivity (sec) |
|---|---|---|
| 2 | No. 7 in Table 1 | 0.26 |
| 3 | No. 9 in Table 1 | 0.28 |
| 4 | No. 11 in Table 1 | 0.25 |
| 5 | No. 13 in Table 1 | 0.23 |
| 6 | No. 14 in Table 2 | 0.26 |
| 7 | No. 18 in Table 2 | 0.24 |
| 8 | No. 21 in Table 2 | 0.28 |
| 9 | No. 24 in Table 2 | 0.24 |
| 10 | No. 27 in Table 3 | 0.25 |
| 11 | No. 34 in Table 3 | 0.26 |
| 12 | No. 2 in Table 4 | 0.15 |
| 13 | No. 3 in Table 4 | 0.28 |
| 14 | No. 4 in Table 4 | 0.30 |
| 15 | No. 5 in Table 4 | 0.27 |
| 16 | No. 6 in Table 4 | 0.26 |
| 17 | No. 7 in Table 4 | 0.30 |
| 18 | No. 9 in Table 4 | 0.28 |
| 19 | No. 15 in Table 4 | 0.25 |
| 20 | No. 18 in Table 5 | 0.28 |
| 21 | No. 24 in Table 5 | 0.27 |
| 22 | No. 28 in Table 5 | 0.28 |

Comparative Examples 1 to 3

Photosensitive products for comparison were manufactured in a manner similar to that described in Embodiment 1 except that one of the compounds T-1, T-2 and T-3 as specified below was used as a charge transporting substance in each product.

(T-1)

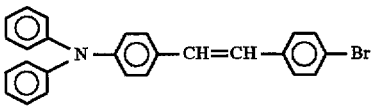

-continued (T-2)

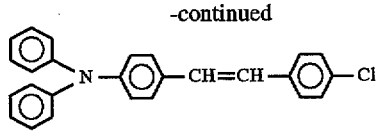

(T-3)

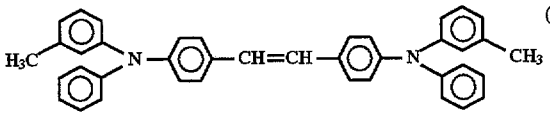

The results of the analysis for the products are shown in Table 7.

TABLE 7

| Comparative Example | Compound | Sensitivity (sec) |
|---|---|---|
| 1 | T-1 | 0.65 |
| 2 | T-2 | 0.70 |
| 3 | T-3 | 0.55 |

Embodiments 23 to 36

An undercoat layer (0.1 μm thick) formed of methoxy methylated nylon (T-8, Unitika, Ltd.) was formed on an aluminum substrate. A charge generating layer (0.1 μm thick) containing T-type phthalocyanine having no metal and a butyral resin. (DENKA BUTYRAL #3000, Denki Kagaku Kogyo K.K.) was formed on the undercoat layer. An oxidation inhibitor (IRGANOX 1010, Japan Ciba-geigy Ltd.) was added in an amount of 1.5 wt. % with respect to the amount of the charge transporting substance. A photosensitive product according to Embodiments 23 to 36 was thus manufactured in a manner similar to that described in Embodiment 1 except that one of the compounds in Tables 1 to 5 other than compound No.3 in Table 1 was used in each product. The results of the analysis for the products are shown in Table 8.

TABLE 8

| Embodiment | Compound | Sensitivity (sec) |
|---|---|---|
| 23 | No. 4 in Table 1 | 1.00 |
| 24 | No. 9 in Table 1 | 1.10 |
| 25 | No. 17 in Table 2 | 1.00 |
| 26 | No. 20 in Table 2 | 0.90 |
| 27 | No. 25 in Table 2 | 1.10 |
| 28 | No. 30 in Table 3 | 0.90 |
| 29 | NO. 31 in Table 3 | 1.10 |
| 30 | No. 5 in Table 4 | 1.10 |
| 31 | No. 7 in Table 4 | 1.30 |
| 32 | No. 9 in Table 4 | 1.20 |
| 33 | No. 11 in Table 4 | 1.15 |
| 34 | No. 14 in Table 4 | 1.20 |
| 35 | No. 23 in Table 5 | 1.35 |
| 36 | Mo. 29 in Table 5 | 1.30 |

Comparative Examples 4 to 6

Photosensitive products for comparison were manufactured in a manner similar to that described in Embodiment 23 except that one of the compounds T-4, T-5 and T-6 as specified below was used as a charge transporting substance in each product.

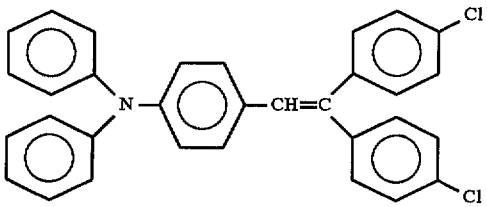

(T-4)

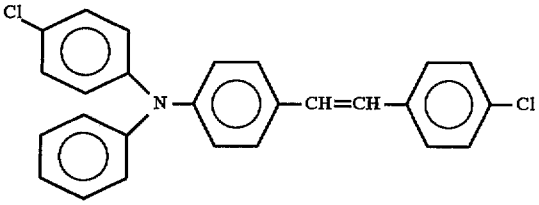

(T-5)

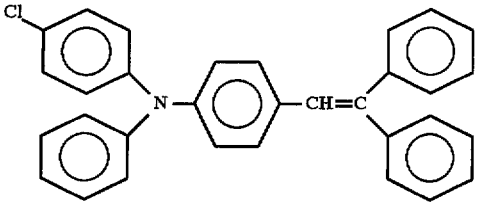

(T-6)

The results of the analysis for the products are shown in Table 9.

TABLE 9

| Comparative Example | Compound | Sensitivity (sec) |
|---|---|---|
| 4 | T-4 | 3.00 |
| 5 | T-5 | 3.50 |
| 6 | T-6 | 3.00 |

What is claimed is:

1. An electrophotographic photosensitive product comprising on a photoconductive substrate a photosensitive layer comprising either a laminate of a charge generating layer and a charge transporting layer, or, a charge transporting layer with a charge generating substance disperse within, said charge transporting layer containing as a main component thereof a compound specified below:

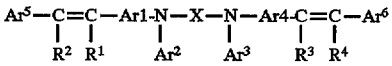

wherein X is —$Ar^7$—CH=CH—$Ar^8$— or a naphthylene group represented by the following formula:

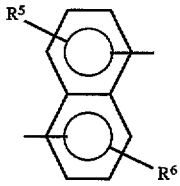

and wherein each of $Ar^1$, $Ar^4$, $Ar^7$, and $Ar^8$ is a substituted or unsubstituted arylene group, each of $Ar^2$, $Ar^3$, $Ar^5$, and $Ar^6$ is a substituted or unsubstituted aryl group, and each of $R^1$–$R^6$ is selected from the group consisting of H, a lower alkyl group that includes one to six carbon atoms and can have a substituent, and a substituted or unsubstituted aryl group.

2. An electrophotographic photosensitive product as defined in claim 1 wherein said aryl group is selected from the group consisting of phenyl, naphthyl and biphenyl.

3. An electrophotographic photosensitive product as defined in claim 1 wherein said arylene group is selected from the group consisting of phenylene, naphthylene and biphenylene.

4. An electrophotographic photosensitive product as defined in claim 1 wherein said alkyl group is selected from the group consisting of methyl, ethyl, propyl, isopropyl, butyl, pentyl and hexyl.

5. An electrophotographic photosensitive product as defined in claim 1 wherein each of said aryl, arylene and alkyl groups has a substituent.

6. An electrophotographic photosensitive product as defined in claim 5 wherein said substituent is selected from the group consisting of an alkyl group, an alkoxy group, an amino group and a halogen.

7. An electrophotographic photosensitive product as defined in claim 6 wherein said constituent alkyl group is selected from the group consisting of methyl, ethyl, propyl, isopropyl, n-butyl, t-butyl, pentyl and hexyl.

8. An electrophotographic photosensitive product as defined in claim 6 wherein said alkoxy group is selected from the group consisting of methoxy, ethoxy, propoxy and butoxy.

9. An electrophotographic photosensitive product as defined in claim 6 wherein said amino group is selected from the group consisting of amino, dimethylamino, diethylamino and diphenylamino.

10. An electrophotographic photosensitive product as defined in claim 6 wherein said halogen is selected from the group consisting of fluorine, chlorine, bromine and iodine.

* * * * *